United States Patent [19]

Kohler

[11] 4,103,559

[45] Aug. 1, 1978

[54] DETENTED MANUAL ACTUATOR FOR A MULTIFUNCTION SYSTEM

[75] Inventor: Ramon C. Kohler, Aurora, Ill.

[73] Assignee: Caterpillar Tractor Co., Peoria, Ill.

[21] Appl. No.: 776,075

[22] Filed: Mar. 9, 1977

[51] Int. Cl.[2] ..... G05G 9/00

[52] U.S. Cl. ..... 74/471 XY; 74/532; 137/636.2

[58] Field of Search ..... 74/471 XY, 473 P, 475, 74/532; 137/636.2

[56] References Cited

U.S. PATENT DOCUMENTS

| | | | |
|---|---|---|---|
| 3,095,754 | 7/1963 | Mayon | 74/471 XY |
| 3,241,640 | 3/1966 | McCordic | 74/475 X |
| 3,541,877 | 11/1970 | Houk | 74/471 XY |
| 3,993,175 | 11/1976 | Beveridge | 74/471 XY |
| 4,027,547 | 6/1977 | Rahman | 74/471 XY |

*Primary Examiner*—Gary L. Smith

*Attorney, Agent, or Firm*—Wegner, Stellman, McCord, Wiles & Wood

[57] ABSTRACT

A manual actuator for a multifunction system including a lever having a manually grippable handle, a first mounting element mounting the lever for movement along a first axis between first and second positions, a second mounting element mounting the first mounting element, and thus the lever, for movement along a second axis intersecting the first axis so that the lever is movable between third and fourth positions, and a detent mechanism carried by the first mounting element and movable therewith along the second axis for holding the lever in at least one of the first and second positions.

8 Claims, 2 Drawing Figures

3
4
16
32
52
50
56
42
40
46
44
30
58
54
74
84
60
34
62
72
36
66

DETENTED MANUAL ACTUATOR FOR A MULTIFUNCTION SYSTEM

BACKGROUND OF THE INVENTION

This invention relates to manual actuators for a multifunction system as, for example, a lever movable fore and aft to control one function of the system and from side to side to control another function of the system.

Manual actuators for multifunction systems have been employed in a wide variety of applications. Perhaps the most common application is in controlling work performing vehicles such as crawler tractors, lift trucks, excavators, and the like. For example, a single actuator may be movable fore and aft to control direction of movement of a vehicle and side-to-side to control some other function of the vehicle as, for example, turning characteristics or the movement of a work performing means. Through the use of such actuators, operation of such vehicles or the like has been considerably simplified in that the operator need not literally "hunt" for individual actuators for each function performed by the system since one actuator may be manipulated to perform two or more functions.

Frequently, there is a need for detenting the actuator in a particular position corresponding to a command to perform a particular function. Not infrequently, such detenting is accomplished through the use of detents within a system element being controlled by the actuator such as, for example, a hydraulic valve. Where cables interconnect the actuator and the element actuated thereby, such a construction presents difficulties in that the cable must not only be sufficiently strong so as to convey actuator movement to the element being controlled, but it must be sufficiently strong so as to transmit the additional force required to move the controlled element in and out of its detented position. Frequently, too, the requirement that force be transmitted through cables to the element being controlled to overcome a detent associated therewith increases the manual effort required to operate the manual actuator.

Finally, in many cases, extremely complicated cable and/or linkages are necessary to achieve interconnection between the actuator and the elements to be controlled thereby.

SUMMARY OF THE INVENTION

The present invention is directed to overcoming one or more of the problems set forth above.

According to the present invention, there is provided a manual actuator for a multifunction system including a lever having a manually grippable handle. A first mounting element mounts the lever for movement along a first axis between first and second positions. A second mounting element mounts the first mounting element, and thus the lever, for movement along a second axis intersecting the first axis so that the lever is movable between the third and fourth positions. A detent mechanism is carried by the first mounting element to be movable therewith along the second axis for holding the lever in at least one of the first and second positions.

Other objects and advantages will become apparent from the following specification taken in connection with the accompanying drawings.

DESCRIPTION OF THE PREFERRED EMBODIMENT

Figure 1:
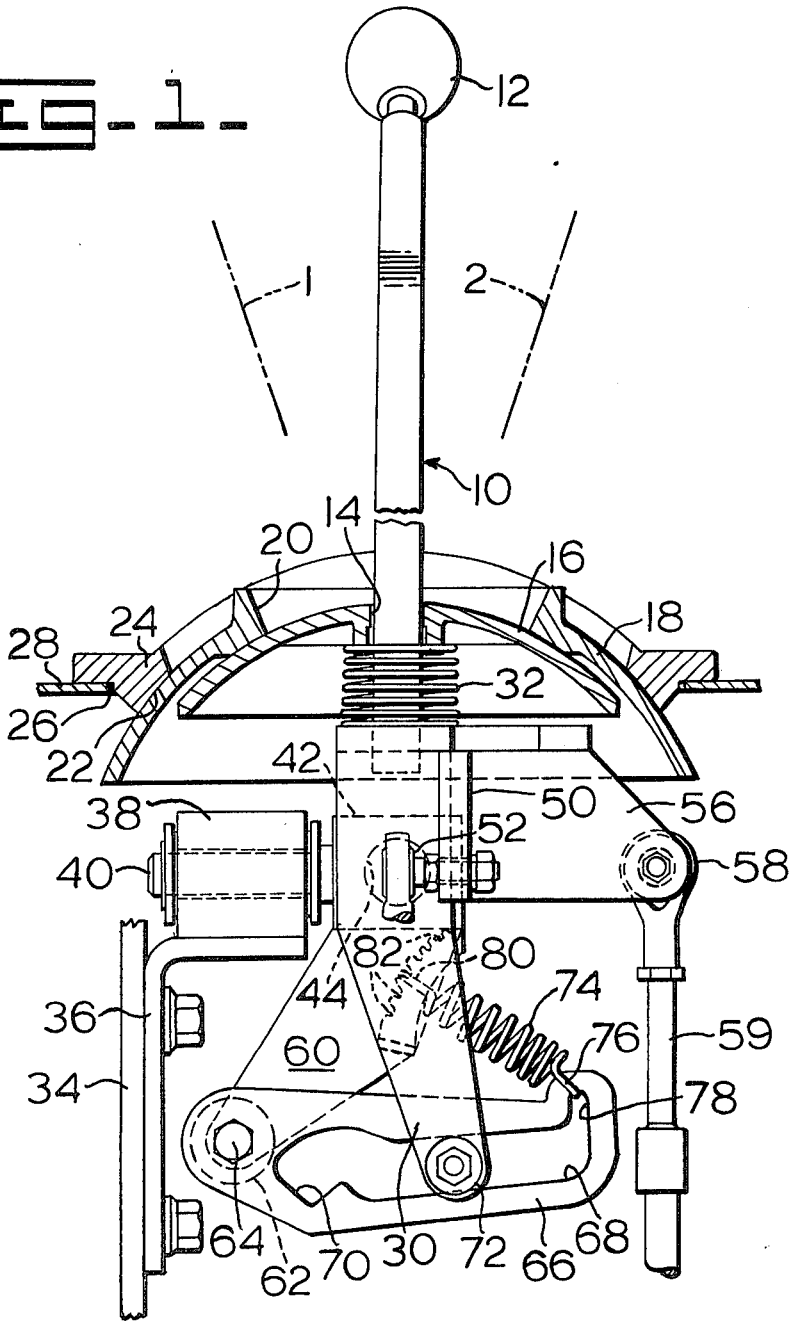
FIG. 1 is an elevational view of a manual actuator made according to the invention with parts shown in section.
Figure 2:
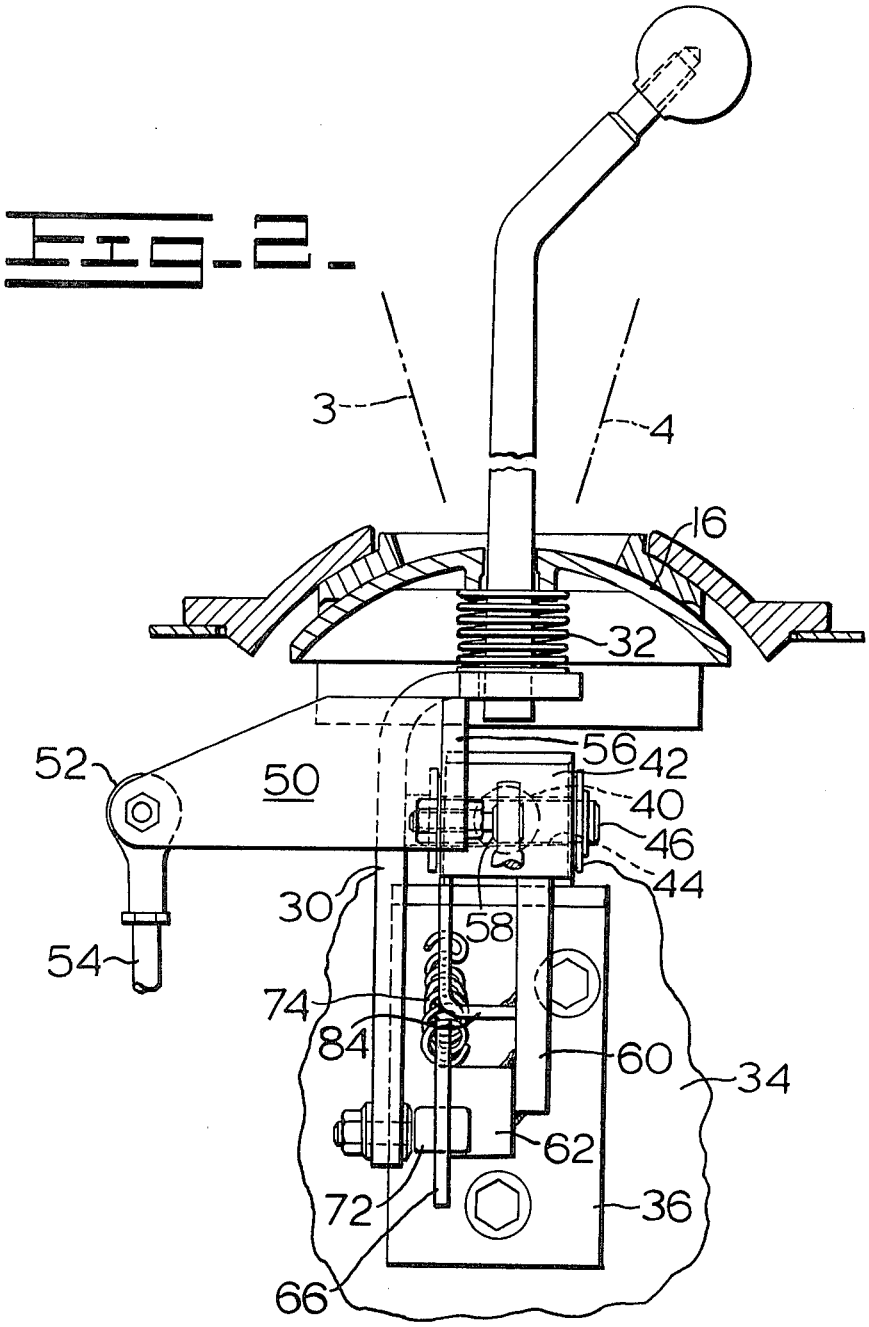
FIG. 2 is a view similar to FIG. 1 taken from a direction angularly displaced 90° to the right of the view of FIG. 1.

An exemplary embodiment of a manual actuator made according to the invention is illustrated in FIGS. 1 and 2 and is seen to include a lever, generally designated 10, having an upper handle 12 in the form of a knob. The lever 10 extends through a bore 14 in a partial spherical section 16 to mechanism to be described in greater detail hereinafter. A second partial spherical element 18 has an enlarged central opening 20 in which the element 16 is disposed. The element 18 slidably engages a spherical surface 22 on the underside of an annular bracket 24 which is received in an opening 26 in a control panel 28. Those skilled in the art will recognize that the elements 16 and 18 essentially act as closures for the opening 26 for all positions of movement of the lever 10.

Below the element 16, the lever 10 includes an inverted L-shaped plate 30. A biasing spring 32 is interposed between the underside of the element 16 and the upper surface of the L-shaped plate 30 to bias the closure members 16 and 18 into firm engagement with each other and with the spherical surface 22.

Below the control panel 28, a frame member 34 mounts an inverted L-shaped bracket 36 which, on its upper surface, mounts a sleeve 38. A stub shaft 40 is journalled in the sleeve 38 and retained therein by any suitable means. The stub shaft 40 is, in turn, secured to a rectangular block 42 having a bore 44 therein. The bore 44 is transverse to the bore of the sleeve 38, and the stub shaft 40 and receives a stub shaft 46 which is secured to the lever 10, and specifically, the vertically extending portion of the inverted L-shaped plate 30. It is also to be observed that the axes of the stub shafts 40 and 46 intersect. As a consequence, the lever 10 is mounted for movement between four extreme positions. When the lever 10 is rotated about the pivot axis defined by the stub shaft 46, as viewed in FIG. 1, it may be moved to a position 1 at one extreme of its permitted movement and to a position 2 at the other extreme of movement. At the same time, if the lever 10 is rotated about the pivot axis defined by the stub shaft 40, as seen in FIG. 2, for one extreme position of such movement, it will assume a third position, while for the other extreme of movement, it will assume a fourth position. Movement of the lever 10 between the first and second positions, as defined above, can be utilized to control one function while movement of the lever between the positions 3 and 4 can be used to control a second function. It will be observed that control of one function can be had completely independently of control of the other function.

To convey such movements to elements to be controlled, the L-shaped plate 30, on one side thereof, mounts a control arm 50 which extends to one side of the pivot axis mentioned previously. At the extremity of the control arm 50, by means of a ball joint 52 located in alignment with the axis of the stub shaft 46 and in the plane defined by the axes of the stub shafts 40 and 46 there is secured a control cable 54 for conveying the movement of the lever 10 to an element to be controlled.

A similar arm 56 is secured to the innermost portion of the arm 50 to extend away from the pivot axes and by means of a ball joint 58 assembled to a control cable 59. The arms 56 and 50 are transverse to each other and it is to be noted that the ball joint 58 is located on the pivot axis of the stub shaft 40 and in the plane defined by the axes of the stub shafts 40 and 46.

Thus, it will be appreciated that the functions can be controlled independently of each other since pivoting of the lever 10 about only one of the pivot axes will not disturb the position of the arm 50 or 56, as the case may be, associated with the other pivot axis.

Secured to the underside of the block 42 is a downwardly extending arm 60 which is directed, as seen in FIG. 1, towards the frame member 34. At the extremity of the arm 60, a sleeve 62 extends to the side thereof and, by means of a bolt 64, pivotally mounts a detent plate 66 which extends away from the frame member 34. The plate 66 includes a elongated slot 68 having an upwardly opening notch 70 adjacent one end thereof. The lower end of the lever 10, and specifically, the lower end of the L-shaped plate 30, mounts a projection 72 in the form of a roller which is received in the slot 68. It will be appreciated that movement of the lever between positions 1 and 2 will cause the roller 72 to shift positions within the slot 68.

A coil tension spring 74 has an end 76 received in a recess 78 in the end of the slot 68 remote from the notch 70 and its opposite end 80 received in a selected one of a plurality of recesses 82 formed in a side of an L-shaped plate 84 remote from the recess 78. As seen in FIG. 2, the L-shaped plate 84 is suitably secured to the underside of the block 42 and to the arm 60.

As a consequence of the above construction, the detent plate 66 will be urged counterclockwise about the pivot defined by the bolt 64 thereby urging the notch 70 toward the roller 72. Shifting of the lever 10 from the position illustrated in FIG. 1 to position 2, as identified in the same Figure, will result in the roller entering the notch 70 whereupon the bias provided by the spring 74 against the detent plate 66 will cause the lever 10 to be held in that position. When it is desired to move the lever out of that position, it need only be shifted toward the position 1 whereupon the roller 72 will cam the plate 66 downwardly about the bolt 64 and against the bias of the spring 74 to release the detenting action.

It will be observed that if the lever is detented in position 2, as mentioned above, it may nonetheless be shifted to either position 3 or 4 to control the function associated therewith without releasing the detent.

It will also be observed that a notch similar to the notch 70 could be formed just below the recess 78 if it is desired to detent the lever 10 in both the positions 1 and 2.

From the foregoing, it will be appreciated that use of the invention does not require separate detenting mechanisms in the elements to be controlled by the actuator, thereby eliminating the need for relatively stiff cables required to transmit the force necessary to detent the mechanism or overcome the detenting action. It will also be appreciated that actuating force is minimized to the extent that use of heavy cables required to transmit detenting force require a greater force application to shift the same.

It will also be appreciated that connections to the elements to be controlled are extremely simple, requiring only that two arms 50 and 56 and the associated ball joints 52 and 58.

The embodiments of the invention in which an exclusive property or privilege is claimed are defined as follows:

1. A manual actuator for a multifunction system, comprising:

a lever element including a manually grippable handle and carrying a first detent formation;

a first mounting element mounting said lever for movement along a first axis between first and second positions;

a second mounting element mounting said first mounting element, and thus said lever, for movement along a second axis intersecting said first axis so that said lever is movable between third and fourth positions;

a detent mechanism carried by said first mounting element, and movable therewith along said second axis for holding said lever in at least one of said first and second positions, said detent mechanism including a second detent formation complementary to said first detent formation for mating engagement therewith;

said first and second detent formations being relatively movable into and out of said mating engagement; and means associated with one of said detent formations and mounted on the element be which said one detent formation is carried for urging said detent formations into said mating engagement.

2. The manual actuator of claim 1 wherein said first mounting element pivotally mounts said lever and said second mounting element pivotally mounts said first mounting element, said axes being pivot axes within a single plane.

3. The mounting axis of claim 2 wherein said axes are transverse to each other.

4. A manual actuator for a multifunction system, comprising:

a lever including a manually grippable handle and a projection on said lever;

a first mounting element mounting said lever for movement along a first axis between first and second positions;

a second mounting element mounting said first mounting element, and thus said lever, for movement along a second axis intersecting said first axis so that said lever is movable between third and fourth positions; and a detent mechanism carried by said first mounting element, and movable therewith along said second axis for holding said lever in at least one of said first and second positions, said detent mechanism including a detent element having a recess opening towards said projection movably mounted on said first mounting element, and means urging said detent element toward said projection.

5. The manual actuator of claim 4 wherein said detent element is pivotally mounted on said first mounting element and said urging means comprises a spring.

6. The manual actuator of claim 5 wherein said spring is connected to said detent element, and further including means for adjusting the spring force applied to said detent element.

7. The manual actuator of claim 1 wherein said axes are located intermediate the ends of said lever and said lever carries a projection spaced from said axes and on the side thereof remote from said handle; and said detent mechanism comprises a plate having a slot and pivotally mounted on said first mounting element and spaced from said axes on said side, said slot receiving said projection and having a notch therein opening toward said projection, and means for biasing said plate such that said notch is urged toward said projection.

8. A manual actuator for a multifunction system, comprising:

a lever including a manually grippable handle;

a first mounting element mounting said lever for movement along a first axis between first and second positions;

a second mounting element mounting said first mounting element, and thus said lever, for movement along a second axis intersecting said first axis so that said lever is movable between third and fourth positions;

said axes being located intermediate the ends of said lever and said lever carries a projection spaced from said axes and on the side thereof remote from said handle;

a detent mechanism carried by said first mounting element, and movable therewith along said second axis for holding said lever in at least one of said first and second positions, said detent mechanism comprising a plate having a slot and pivotally mounted on said first mounting element and spaced from said axes on said side, said slot receiving said projection and having a notch therein opening toward said projection; and means for biasing said plate such that said notch is urged toward said projection, said biasing means comprising a tension spring connected to said plate, and means defining a series of recesses and carried by said first mounting element, said recesses each being adapted to selectively receive an end of the spring remote from said plate for adjusting spring tension.

* * * * *